US006615550B2

(12) United States Patent
Reuschel et al.

(10) Patent No.: US 6,615,550 B2
(45) Date of Patent: Sep. 9, 2003

(54) COVERED WORK SPACE ARRANGEMENT

(75) Inventors: Jeffrey J. Reuschel, Hamilton, MI (US); Ralph E. Reddig, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/882,278

(22) Filed: Jun. 15, 2001

(65) Prior Publication Data

US 2002/0189170 A1 Dec. 19, 2002

(51) Int. Cl.[7] ..... E04H 1/00

(52) U.S. Cl. ..... 52/36.2; 52/66; 52/71; 52/72; 52/86; 135/121; 135/122; 135/124

(58) Field of Search ..... 52/36.2, 66, 70, 52/71, 72, 73, 79.7, 79.2, 239, 86; 135/121, 122, 114, 117, 87, 124, 158, 900, 902, 906, 97, 98, 95

(56) References Cited

U.S. PATENT DOCUMENTS

| | | | | |
|---|---|---|---|---|
| 2,535,618 A | | 12/1950 | Williams | |
| 3,765,134 A | * | 10/1973 | Gilchrist | 52/63 |
| 3,847,170 A | * | 11/1974 | Anderson | 135/116 |
| 3,925,942 A | * | 12/1975 | Hemmelsbach | 135/122 |
| 3,961,442 A | * | 6/1976 | Carter | 52/63 |
| 4,387,533 A | * | 6/1983 | Green et al. | 47/17 |
| 4,766,919 A | * | 8/1988 | Crates | 135/97 |
| 4,837,990 A | * | 6/1989 | Peleg | 52/63 |
| 5,193,327 A | * | 3/1993 | Goodenberger | 135/100 |
| 5,197,238 A | * | 3/1993 | Peleg | 52/13 |
| 5,245,802 A | * | 9/1993 | Davis | 135/97 |
| 5,282,341 A | | 2/1994 | Baloga et al. | |
| 5,452,547 A | | 9/1995 | Baloga et al. | |
| 5,511,348 A | | 4/1996 | Cornell et al. | |
| D376,854 S | * | 12/1996 | DiPaolo | 52/18 |
| 5,603,370 A | * | 2/1997 | Boer | 160/135 |
| 5,802,778 A | | 9/1998 | Thorp et al. | |
| 6,003,275 A | | 12/1999 | Cornell et al. | |
| 6,053,588 A | * | 4/2000 | Biggel et al. | 312/249.11 |
| 6,151,852 A | * | 11/2000 | Linn et al. | 256/24 |
| 6,247,484 B1 | * | 6/2001 | Thomas | 135/120.3 |
| 6,283,136 B1 | * | 9/2001 | Chen | 135/130 |
| 6,367,495 B1 | * | 4/2002 | Powell et al. | 135/115 |

FOREIGN PATENT DOCUMENTS

| | | | |
|---|---|---|---|
| GB | 2043142 | * 10/1980 | E04G/21/32 |
| JP | 3-93946 | * 9/1989 | E04B/2/74 |

* cited by examiner

*Primary Examiner*—Carl D. Friedman
*Assistant Examiner*—Chi Q. Nguyen
(74) *Attorney, Agent, or Firm*—Flynn, Thiel, Boutell & Tanis, P.C.

(57) ABSTRACT

A space-dividing covered work space arrangement including a pair of opposed side modules each of a three-wall construction defined by an upright panel arrangement and a pair of upright end walls disposed at opposite ends thereof and projecting inwardly therefrom. A pair of canopies project inwardly from each of the opposed modules and are attached along inner edges thereof so as to define a continuous canopy assembly which overlies and encloses the work space from above.

20 Claims, 3 Drawing Sheets

COVERED WORK SPACE ARRANGEMENT

FIELD OF THE INVENTION

This invention generally relates to an arrangement which defines a covered work space for conferencing or accommodating groups of workers.

BACKGROUND OF THE INVENTION

Conventional wall panels are frequently used to subdivide large open office areas into a plurality of individual workstations which are then provided with furniture components such as work surfaces, shelves and the like. However, the demand for office environments adapted for accommodating groups or teams of workers has increased. Accordingly, a need exists for an arrangement which defines a work area which allows for increased interaction between office workers than that provided by conventional wall panel arrangements, and which provides a semi-private meeting area within a larger office space.

The present invention therefore relates to an improved, work space arrangement defined by a pair of opposed identical halves or modules. The respective modules are of a three-wall construction, with the open sides thereof disposed in face-to-face relation so that the modules together define an interior work area. Each of the modules includes an upright side panel arrangement and a pair of upright end walls oriented transversely with respect to the respective panel arrangement. Further, a pair of canopies are cantilevered inwardly from each of the opposed modules and are attached to one another along inner edges thereof so as to define a continuous canopy assembly which overlies and encloses the work area from above. In addition, the canopy assembly serves to isolate sound near the work area and minimizes the entry of unwanted outside sound into the work area.

Other objects and purposes of the invention will be apparent to persons familiar with arrangements of this general type upon reading the following specification and inspecting the accompanying drawings.

Figure 1:
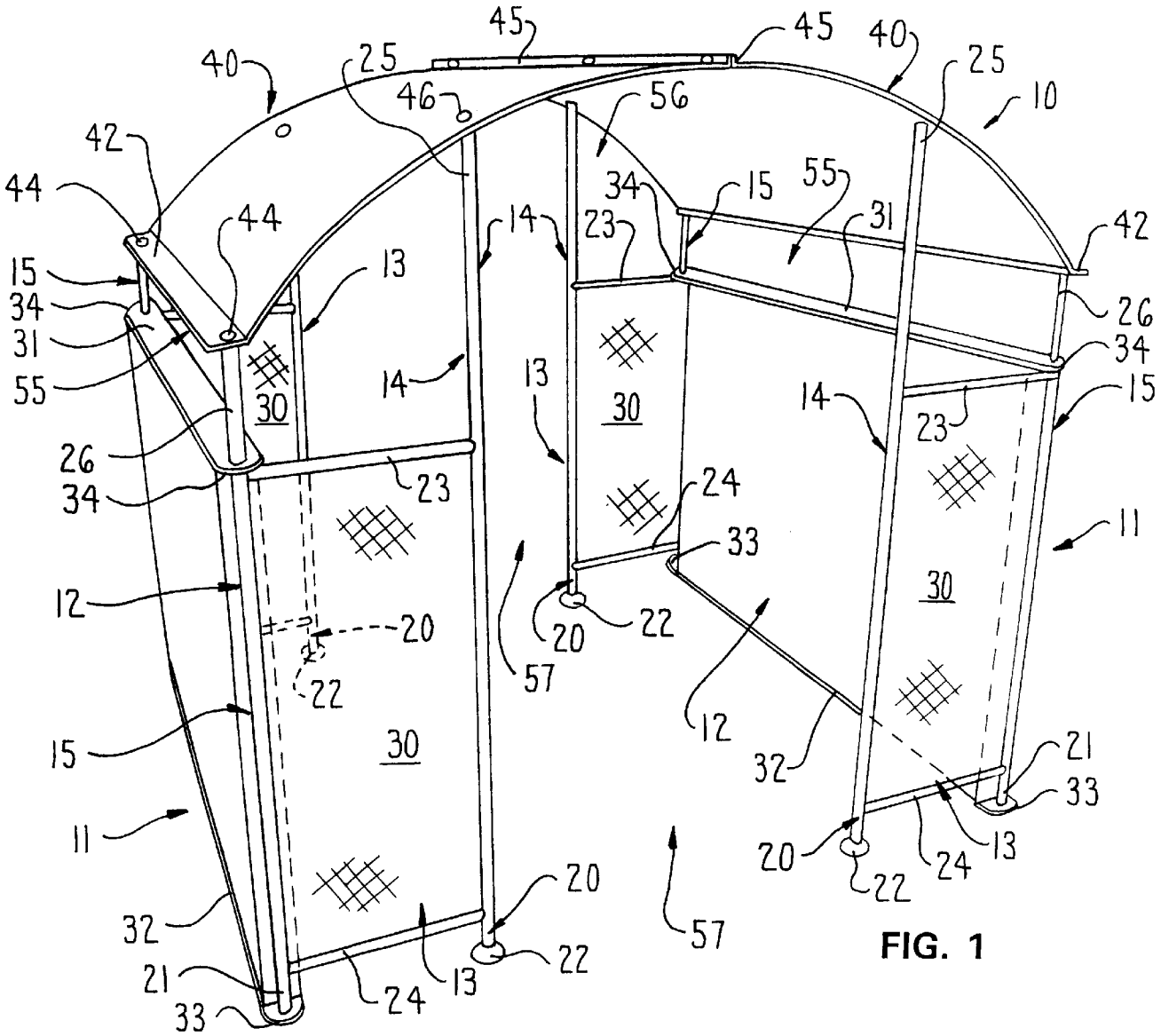
FIG. 1 is a perspective view of the work space arrangement according to the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figures 2, 3:
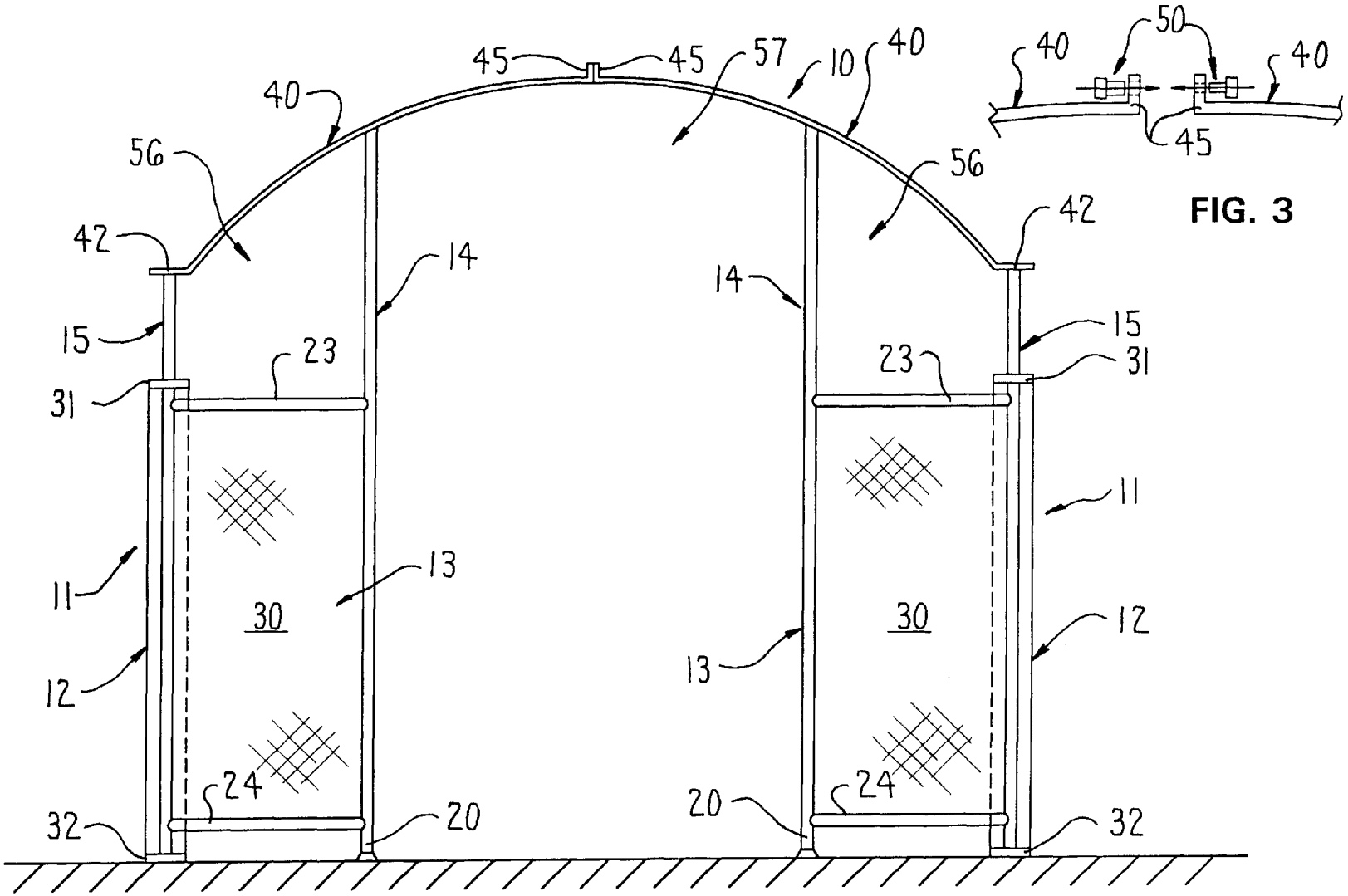
FIG. 2 is a front end view of the work space arrangement of FIG. 1, the rear end view being identical thereto.
FIG. 3 is an enlarged, fragmentary detail view of the connection between the pair of opposed canopies.

Referring to FIGS. 1 and 2, there is illustrated a space-dividing work space arrangement 10 which is defined by a pair of modules 11 which are oriented in opposed relation with one another so as to define an at least partially-enclosed work space therein. The respective modules 11 are identical to one another, and only one of which will therefore be described in detail herein.

Module 11 includes an upright, space-dividing wall panel arrangement 12 which in the illustrated embodiment defines a longitudinal side of the module 11. The wall panel arrangement 12 may be of the conventional stackable type including one or more serially arranged base panel assemblies disposed in an end-to-end manner. One or more extension panel assemblies are then stacked on the respective base panel assemblies to create a wall of the desired height. The serially arranged base and extension panel assemblies are typically interconnected by an upright support post disposed in load-bearing relation with the floor. One example of this type of panel arrangement is disclosed in U.S. Pat. No. 6,052,958 which is owned by the same assignee hereof and incorporated by reference herein.

Alternatively, the wall panel arrangement 12 may be of the conventional type including one or more panel assemblies each consisting of a main panel member having a generally rectangular ring-like frame defined by generally parallel and horizontally elongated top and bottom frame rails which are rigidly joined together adjacent opposite ends thereof by generally parallel and vertically elongated side frame rails. This ring-like frame surrounds a conventional core structure, with the frame and core structure being sandwiched between a pair of side members which cover the entire opposite sides of the panel member and are typically covered by an exterior covering, such as a thin flexible fabric. Opposite edges of each panel assembly may be supported by respective uprights or posts positioned in load-bearing relation with the floor, with serially adjacent ones of these panel assemblies may be connected through a common one of these posts. Alternatively, the panel members may be disposed in direct load-bearing relation with the floor, such as by appropriate feet or glides.

A pair of upright and identical end walls 13 are respectively cantilevered inwardly from opposite vertical edges of the wall panel arrangement 12 and are transversely oriented relative thereto. In the illustrated embodiment, the end walls 13 are perpendicular to the wall panel arrangement 12. Each end wall 13 includes a rigid frame defined by a pair of upright inner and outer posts 14 and 15 which are laterally spaced from and generally parallel to one another. The lower ends 20 and 21 of the respective posts 14 and 15 are disposed in load-bearing relation with the floor, and inner post 14 mounts thereon an enlarged support foot 22. Inner post 14 is of a greater vertical height than outer post 15. Posts 14 and 15 are interconnected by upper and lower generally parallel cross members 23 and 24 which are vertically spaced from one another. In the illustrated embodiment, lower cross member 24 is spaced a short distance upwardly from the lower ends 20 and 21 of posts 14 and 15, and upper cross member 23 is spaced downwardly from upper terminal ends 25 and 26 of posts 14 and 15 and is oriented at a height which is approximately the same as the height of the upper edge portion of the respective wall panel arrangement 12.

Each end wall 13 additionally includes a vertically oriented screen or panel 30 which extends between the open area defined between posts 14 and 15 and the respective cross members 23 and 24. Screen 30 may be constructed of an open, mesh-like fabric to allow the passage of light and air therethrough, or alternatively may be constructed of a tightly woven fabric or rigid panel member which is opaque to create additional privacy with in the work area.

The laterally spaced end walls 13 are interconnected to opposite upright end edges of the respective wall panel arrangement 12 by upper and lower elongate and generally horizontally oriented mounting plates 31 and 32 which respectively extend along and are fixed to upper and lower horizontal edge portions of the wall panel arrangement 12. In the illustrated embodiment, lower mounting plate 32 defines an opening or recess therein adjacent each transverse edge 33 thereof which respectively receive the lower ends 21 of outer posts 15. The upper mounting plate 31 defines an opening therein adjacent each transverse edge 34 thereof through which the upper ends 26 of outer posts 15 extend above the intersection of the upper cross member 23 and outer post 15. To provide a rigid connection between the wall panel arrangement 12 and the respective end walls 13, the outer posts 15 may be secured to one or both of the upper and lower mounting plates 31 and 32 by welding or another suitable fastening method.

The upper ends 25 and 26 of inner and outer posts 14 and 15 are disposed in supportive engagement with a cover or canopy 40 which is cantilevered inwardly from module 11. The canopy 40 has an arcuate or upwardly convex shape with a lower edge which is defined by a sidewardly projecting and generally horizontally oriented lower flange 42 which extends along the entire longitudinal extent thereof. Lower flange 42 is secured to the upper end 26 of each outer post 15 via fasteners 44. Flanges 42 are parallel to the respective upper mounting brackets 31 and are vertically aligned therewith.

Canopy 40 additionally includes an upper edge which defines an upwardly projecting and generally vertically oriented upper flange 45 which extends along the entire longitudinal extent of canopy 40. The upper ends 25 of each of the laterally spaced inner posts 14 support canopy 40 at a central region along each transverse end edge thereof and are secured thereto with fasteners 46. Alternatively, canopy 40 may be supported along the respective transverse end edges thereof through elongate and arcuately shaped rigid supports which respectively extend between and are fixed to the upper ends 25 and 26 of the inner and outer posts 14 and 15 and support canopy 40 from below.

The canopies 40 may be constructed of a rigid material such as molded plastic or fiberglass, or alternatively may be constructed of a fabric supported on a frame structure which is secured to the upper ends 25 and 26 of the inner and outer posts 14 and 15. Further, canopies 40 constructed of a rigid material may be provided with perforations or openings to allow the passage of air and light therethrough.

The work space arrangement 10 is assembled by positioning the modules 11 in opposed relation with one another, so that the open sides thereof face one another. The opposed, upwardly projecting flanges 45 are then fastened to one another with a suitable fastening arrangement 50 (FIG. 3), such as a pin-and-sleeve type arrangement, which extends through aligned openings formed in the respective flanges 45. The opposed flanges 45 are preferably connected to one another in the above manner at a plurality of locations along the longitudinal extent of the flanges 45 to securely fasten the canopies 40 to one another.

The opposed modules 11 arranged in the above manner thus define a work space which is enclosed from above by the interconnected canopies 40, partially enclosed from the sides by the respective laterally spaced wall panel assemblies 12, and partially enclosed by at the ends at the respective laterally spaced end walls 13. The opposed pairs of inner posts 14 of the respective modules 11 are sidewardly spaced from one another so as to define an entry or exit area 57.

The upper mounting plates 31 on opposite sides of the arrangement 10 are spaced downwardly from the respective lower flanges 42 to define elongate and sidewardly open areas 55. Upper cross members 23, the inner and outer posts 14 and 15, and the respective transverse end edges of the canopies 40 define front and rear open areas 56. The open areas 55 and 56, as well as the entry/exit areas 57 thus provide the work space arrangement 10 with an open feeling, and additionally allow increased circulation of air, while at the same time the wall panel assemblies 12, end walls 13 and canopies 40 define a semi-private work area for accommodating group interaction or conferencing.

Figures 4, 5:
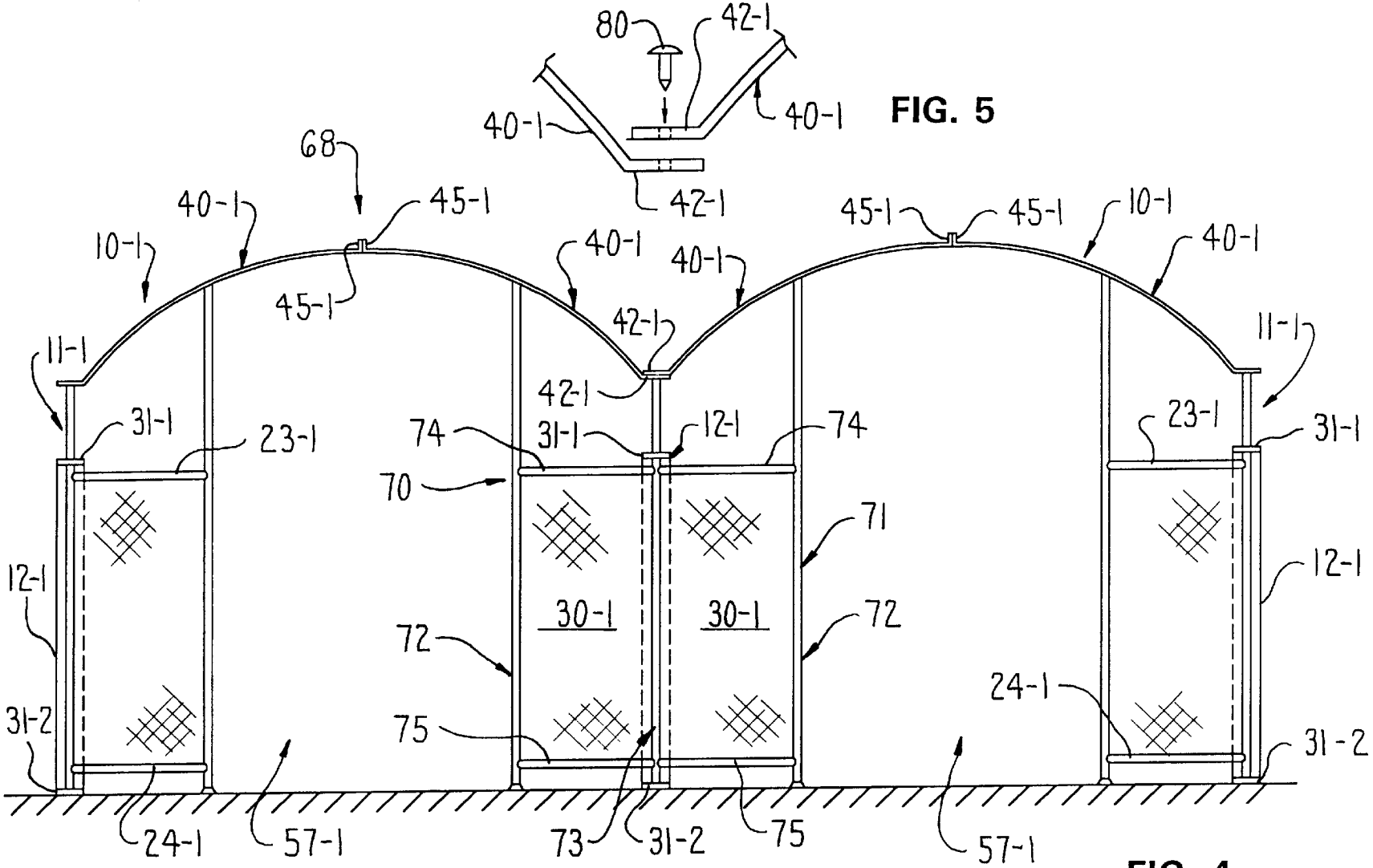
FIG. 4 is a front side view of an additional embodiment including a pair of interconnected work space arrangements arranged in side-by-side relation with one another.
FIG. 5 is an enlarged, fragmentary detail view of the connection between the canopies of the adjacent work space arrangements illustrated in FIG. 4.

FIGS. 4 and 5 illustrate an additional embodiment of the invention which includes a pair of work space arrangements arranged in side-by-side relationship with one another which are structurally similar to the above arrangement 10. Therefore, components which are similar or identical to components of arrangement 10 are identified with the same reference number plus a "−1".

The arrangement 68 illustrated in FIG. 4 is defined by a pair of adjacent and interconnected work space arrangements 10-1, each of which includes a module 11-1 which is identical to the above-described modules 11 of arrangement 10. However, the adjacent work space arrangements 10-1 share a centrally located divider wall assembly 70 which separates the work areas defined by each of the arrangements 10-1. More specifically, divider wall assembly 70 includes a wall panel arrangement 12-1 to which upper and lower mounting plates 31-1 and 32-1 are secured. A pair of identical and laterally spaced end wall assemblies 71 (only one of which is shown in FIG. 4) are respectively mounted to opposite vertical end portions of the wall panel arrangement 12-1 via mounting plates 31-1 and 32-1. Each end wall assembly 71 includes a pair of generally parallel outer upright posts 72 and a center upright post 73 located therebetween and generally parallel thereto. A pair of upper cross members 74 are fixed to and extend in opposite directions from an upper part of the center post 73 and are joined to the respective outer posts 72. A pair of lower cross members 75 which are generally parallel to and spaced downwardly from upper cross members 74 are fixed to extend in opposite directions from a lower part of center post 73 and join to the respective outer posts 72. The upper and lower cross members 74 and 75 are oriented at approximately the same height as the upper and lower cross members 23-1 and 24-1 of the respective adjacent modules 11-1.

A pair of screens or panels 30-1 are mounted on each of the end wall assemblies 71 so as to extend between the center post 73, the respective outer posts 73 and upper and lower cross members 74 and 75.

Each work space arrangement 10-1 includes an inner canopy 40-1 adjacent divider wall assembly 70 which is joined to the respective adjacent outer canopy 40-1 via the opposed upper flanges 45-1, and the lower flanges 42-1 of the respective inner canopies 40-1 are arranged in vertically stacked and overlapping relationship with one another atop the upper end of center post 73 (see FIG. 5). The lower overlapping flanges 42-1 are secured to one another and to center post 73 via fasteners 80 along the longitudinal extents thereof. The upper ends of the outer posts 72 are disposed in supportive engagement with the respective inner canopies 40-1 and are fixed thereto with fasteners. Further, the center posts 73 have lower ends which seat within corresponding openings or recesses defined in opposite ends of the lower mounting plate 32-1, and the upper ends of the center posts 73 extend upwardly through openings defined in respective opposite ends of the upper mounting plate 31-1 to secure the end wall assemblies 71 to the wall panel arrangement 12-1.

The above-described work space arrangements 10 and 10-1 define work areas suited for groups or teams of individuals, and are particularly suited for groups of four or less. The work space arrangement 10, in one embodiment, defines a six-by-six foot work area, with the entry/exit areas being approximately three feet across, each of the end walls 13 having an inward extension of approximately one and a half feet as measured from the junction thereof with the respective wall panel arrangement, and the wall panel arrangement being approximately six feet in length as same extends between the respective end walls. The joined canopies 40 have a dimension as measured between the opposite end edges thereof adjacent the respective end walls of approximately six feet, and a dimension as measured between the respective flanges 42 of at least six feet. The dimensions of each of the adjacent work space arrangements 10-1 are similar to the above dimensions of arrangement 10.

The work space arrangement 10 and the side-by-side arrangements 10-1 thus define semi-private work areas suitable for group gatherings or conferencing, and office furniture components such as tables and seating can be arranged within the interiors of the arrangements as desired. Shelving or other office-type accessories can also be mounted to the respective wall panel arrangements as is conventional. If additional privacy is desirable or necessary, doors may be provided to close off one or both of the entry/exit areas, for example by swingably mounting same on the upright inner posts.

Further, the work space arrangement 10 may be disassembled by disconnecting the upper flanges 45 of the mating canopies 40, and the side modules 11 may be sufficiently rigid to allow movement of the modules 11 to another location.

It will be appreciated that a smaller work area can be created utilizing a single module which is similar to the above discussed modules 11. For example, one module consisting of a wall panel arrangement 12, a single canopy 40 and a pair of end walls similar to end walls 13 can be utilized to define a work area suitable for one or two persons. The end walls in this arrangement would however include inner upright posts which supportively engage the canopy under the respective transverse end edge thereof adjacent the free longitudinal edge of the canopy (i.e. the inner posts 14 would be shifted rightwardly with respect to the left module 11 in FIG. 2), and the upper and lower cross members of the respective end walls would join to these inner posts such that a screen or panel having a width of approximately three feet would extend between the inner and outer posts and upper and lower cross members. This arrangement thus opens sidewardly between the respective inner posts, or alternatively could be provided with a door arrangement swingably mounted to one or both of the inner posts to provide additional privacy. The doors could include a mesh-type fabric or alternatively could be provided with a more rigid construction so as to enable the mounting of office-type components thereon such as shelves and the like. This smaller arrangement can define a work area of which is approximately three-by-six feet.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A work space arrangement comprising:

a pair of modules, each said module including: an upright side wall; a pair of upright end walls projecting transversely from respective opposite vertical edge portions of the respective side walls; and a canopy having a first longitudinal edge portion disposed adjacent and supported on an upper longitudinal edge portion of the respective side wall and a second longitudinal edge portion spaced horizontally from the respective side wall such that said canopy is cantilevered inwardly therefrom, each said module having a three-sided configuration as defined by said side and end walls thereof;

said pair of modules being disposed in opposed relation with one another with open sides thereof oriented in face-to-face relation to define an interior work space, said side wall of one module being laterally spaced from and disposed in facing relationship with said side wall of the opposite module and said end walls of said one module being disposed in end-to-end relationship with the respective end walls of said opposite module, said canopies each having an upwardly arcuate shape with said second longitudinal edge portions of the respective canopies being fixed to one another such that the respective canopies together define a top end of the work space arrangement and substantially cover the interior work space, said second longitudinal edge portions defining an upper extent of said top end.

2. The arrangement of claim 1 wherein said upper edge portion of each said side wall is spaced downwardly from said first longitudinal edge portion of the respective canopy to define an opening therebetween.

3. The arrangement of claim 2 wherein said upper edge portion of each said end wall is spaced downwardly from a transverse edge portion of the respective canopy to define an opening therebetween.

4. The arrangement of claim 1 wherein said side walls are respectively defined by interior, space-dividing wall panel arrangements.

5. The arrangement of claim 4 wherein said end walls of the respective modules include upright panel members disposed in perpendicular relationship with the respective wall panel arrangement.

6. The arrangement of claim 5 wherein said panel members are each constructed of a mesh-type screen to allow the passage of air and light therethrough.

7. The arrangement of claim 1 wherein said end walls on one side of the arrangement have respective vertically oriented edge portions which are disposed in laterally spaced end-to-end relationship with one another to define an opening for entering or exiting the interior work space.

8. The arrangement of claim 1 wherein each pair of said end walls on opposite sides of the arrangement have vertical end edges which are disposed in laterally spaced end-to-end relationship with one another to define an opening for entering into or exiting from the interior work space.

9. The arrangement of claim 1 wherein each said second longitudinal edge portion defines thereon a generally vertically oriented flange, said flanges being disposed in face-to-face relation with one another and connected together with fasteners.

10. The arrangement of claim 1 wherein said end walls each include a pair of generally parallel uprights having lower ends disposed in supportive engagement with a floor and upper ends disposed in supportive engagement with the respective said canopy.

11. The arrangement of claim 10 wherein said end walls each include a pair of vertically spaced cross members which interconnect the respective uprights adjacent upper and lower ends thereof, and a panel extends laterally between said uprights and vertically between said cross members.

12. The arrangement of claim 11 wherein each said side wall defines a lower longitudinal edge portion spaced downwardly from the respective upper longitudinal edge portion thereof, said side walls are respectively defined by interior, space-dividing wall panel arrangements, and upper and lower elongate mounting plates are respectively disposed on said upper and lower longitudinal edge portions of each said panel arrangement, and opposite transverse ends of each said upper and lower mounting plate are respectively fixed to upper and lower portions of outer ones of said uprights to secure said end walls to the respective panel arrangement.

13. The arrangement of claim 10 wherein said second longitudinal edge portion of each said canopy is an upper canopy edge portion and said first longitudinal edge portion of each said canopy is a lower canopy edge portion which is spaced vertically downwardly and horizontally outwardly from the respective said upper canopy edge portion, each said lower canopy edge portion defining a generally horizontally oriented and sidewardly projecting first flange which is mounted to upper ends of outer ones of the respective uprights adjacent opposite ends of said side wall, and each said upper canopy edge portion defining a generally vertically oriented second flange, said second flanges being disposed in superimposed relationship with one another and fastened to one another.

14. The work space arrangement of claim 1 wherein said modules are identical in construction.

15. The work space arrangement of claim 1 wherein one of said modules includes a second pair of upright end walls which project in an opposite direction from the respective end walls of said one module, said canopies are a first pair of canopies and a second pair of said canopies are disposed in sidewardly adjacent relation with said first pair of canopies and have opposed and fixed longitudinal edge portions, one of said second pair of canopies having a terminal longitudinal edge portion opposite said longitudinal edge portion thereof which is supported by said one module and the other of said second pair of canopies having a terminal longitudinal edge portion supported by an additional module which is identical to the other module.

16. The arrangement of claim 1 wherein said modules are connected to one another solely along said second longitudinal edge portions of the respective canopies.

17. A work space arrangement defined by right and left identical and opposed modules, each said module including an upright and elongate side wall and a pair of end walls, each said end wall having an outer generally vertically oriented edge portion fixed to a generally vertically oriented terminal edge portion of the respective side wall such that said end walls project transversely from opposite sides of the respective side wall and together therewith define a sidewardly opening area of the respective module, said modules being oriented in opposed relation with one another with said sidewardly opening areas facing one another, each said module further including an arcuate roof structure having a first longitudinal edge portion supported on the respective side wall and a second longitudinal edge portion spaced horizontally and upwardly from the respective first longitudinal edge portion, said second longitudinal edge portions being fastened to one another such that said roof structures of the respective modules together define a continuous and upwardly arcuate roof which closes off an upper end of said arrangement, said first longitudinal edge portions being spaced upwardly from respective upper edge portions of the respective side walls to define openings therebetween which allow the passage of air and light through said arrangement.

18. The arrangement of claim 17 wherein said roof of said arrangement has longitudinal edges respectively defined by said first longitudinal edge portions of said roof structures, and said roof includes a pair of transverse edges each of which is defined by a pair of aligned transverse edges of the respective roof structures, said transverse edges of said roof being spaced upwardly from upper edge portions of each pair of said end walls on opposite sides of said arrangement.

19. The arrangement of claim 17 wherein each said second longitudinal edge portion defines thereon a generally upright flange, said flanges of the respective second longitudinal edge portions being disposed in face-to-face opposed relation with one another and secured together with at least one fastener.

20. The arrangement of claim 19 wherein each said flange is integrally formed with the respective roof structure.

* * * * *